US006119734A

United States Patent [19]

Kurmis

[11] Patent Number: 6,119,734

[45] Date of Patent: Sep. 19, 2000

[54] CABLE BINDING TOOL

[75] Inventor: Viktor Kurmis, Pinneberg, Germany

[73] Assignee: Paul Hellermann GmbH, Pinneberg, Germany

[21] Appl. No.: 09/269,947

[22] PCT Filed: Oct. 8, 1997

[86] PCT No.: PCT/EP97/05546

§ 371 Date: Apr. 8, 1999

§ 102(e) Date: Apr. 8, 1999

[87] PCT Pub. No.: WO98/15458

PCT Pub. Date: Apr. 16, 1998

[30] Foreign Application Priority Data

Oct. 10, 1996 [DE] Germany ..... 296 17 650 U

[51] Int. Cl.[7] ..... B21F 9/00

[52] U.S. Cl. ..... 140/123.5; 254/216

[58] Field of Search ..... 254/216; 140/93 A, 140/93.2, 123.5, 123.6

[56] References Cited

U.S. PATENT DOCUMENTS

| | | | |
|---|---|---|---|
| 3,205,916 | 9/1965 | Willis | 140/123.6 |
| 4,610,067 | 9/1986 | Hara | 29/33.5 |
| 4,934,416 | 6/1990 | Tonkiss | 140/93.2 |

*Primary Examiner*—Lowell A. Larson
*Attorney, Agent, or Firm*—Alix, Yale & Ristas, LLP

[57] ABSTRACT

A cable binding tool for binding a belt around an object employs a novel arrangement of support rollers on an adjustably spring loaded abutment to urge the belt against a toothed tightening wheel. The tightening wheel is continuously driven during the tightening operation, continuing to rotate with respect to the belt even after the desired belt tension has been achieved. The arrangement of support rollers takes advantage of the stiffness of the belt to equalize the force acting per unit length between the belt and the tightening roller over that portion of the circumference of the tightening roller in contact with the belt.

17 Claims, 1 Drawing Sheet

CABLE BINDING TOOL

CROSS REFERENCE TO RELATED APPLICATIONS

Figure 1:
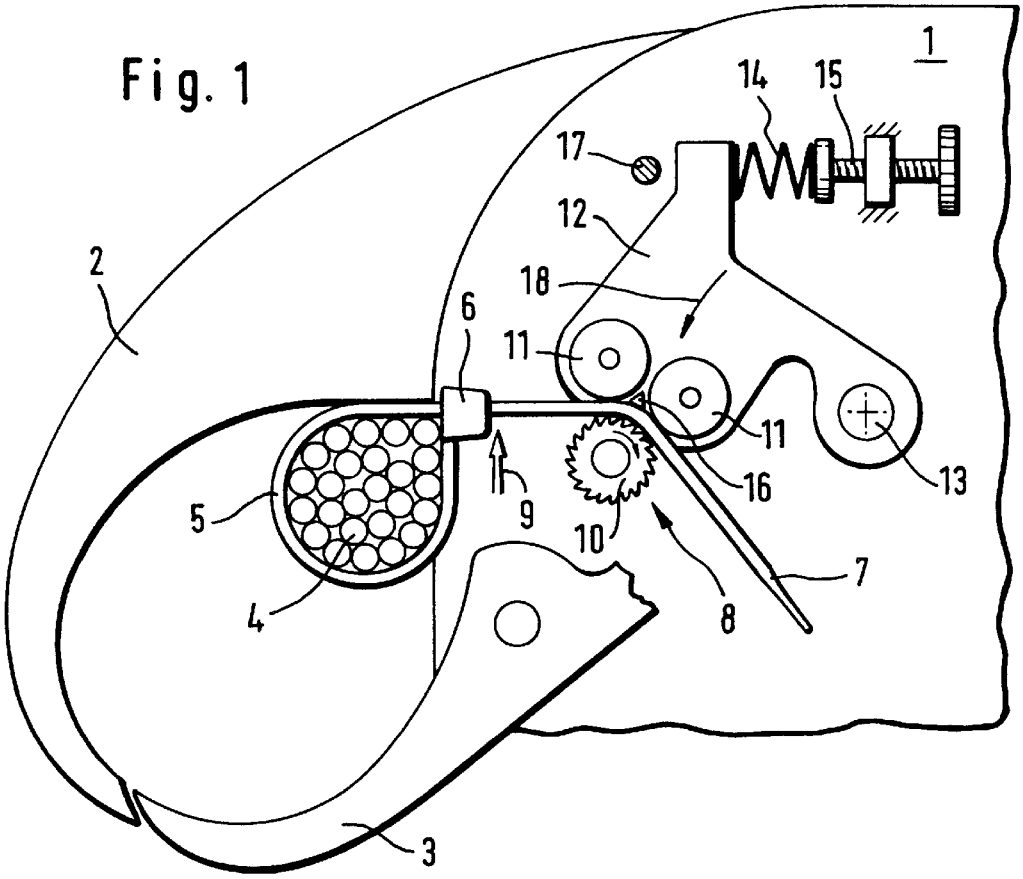

This is the national stage of International Application No. PCT/EP97/05546 filed Oct. 8, 1997.

The invention relates to a tool for binding a belt around an object, in particular around a cable harness, which tool contains a tightening device for the tough elastic belt which is resistant to bending. The tightening device comprises a toothed tightening roller and a roller abutment which supports the belt on the side opposite to the tightening roller. The tightening roller is continuously driven during the tightening operation and also continues to rotate when, on reaching a predetermined belt tension, the belt is at a standstill and is cut through.

In a known tool of this type (EP-A 432477) the tightening roller and the roller abutment, which is formed by a single support roller, are connected to one another at a constant axial distance. The sharp teeth of the tightening roller engage in the surface of the belt which consists of tough elastic plastic. When it reaches its predetermined belt tension, the tensile force exerted on the belt by the teeth of the tightening roller is no longer sufficient to move it further; it comes to a halt and the teeth of the tightening roller cut into the surface of the belt. Although this does lead to belt tension values which can be reproduced extremely well, since this tension is independent of any frictional influences on the surface of the belt, the wear to the belt is a detrimental factor. Also, while the belt is at a standstill, with increasing wear thereto, the force exerted on the belt by the tightening roller falls, so that the belt may move backwards slightly but, in some cases, to a sufficient extent to make it difficult for the protruding end of the belt to be cut through cleanly and tightly.

Also known are belt tightening tools (EP-A-371,290, U.S. Pat. No. 4,610,067) in which the limit tension to be reached is set by means of a slipping clutch on the tightening roller. In the case of this type of tool, it is necessary to ensure that the belt does not slip through with respect to the tightening roller, since otherwise there is no guarantee of reaching the desired belt tension. Secure attachment of the belt to the tightening roller is ensured by the fact that a plurality of support rollers are provided which press the belt against the circumference of the tightening roller. Since providing a special slipping clutch is costly, the present invention is based on the prior art explained above in which it is provided for the slipping through on reaching the desired belt tension to take place between the belt and the tightening roller.

The invention is based on the object, in the case of a cable binding tool, of improving the reproducibility of the belt tension and to prevent it from decreasing during the tightening operation.

The abutment is formed by at least two support rollers which are arranged one behind the other on the circumference of the tightening roller and are pressed towards the tightening roller by spring force. They have the effect of pressing the belt onto the tightening roller not only at the contact points of the support rollers but also, owing to its resistance to bending, in the entire section between these points. Thus the tightening roller interacts with the belt not merely, as it were, in a punctiform manner, but rather over an extended distance which is delimited by the support rollers. The consequence of this is that the pressure, i.e. the force with which the belt is pressed onto the circumference of the tightening roller per unit length, can be reduced, and consequently the teeth of the tightening roller do not, or scarcely, cut into the material of the belt in an abrasive manner when the belt is at a standstill. Generally there are only plastic deformations. This result is surprising because experience has shown that the influence of changing surface conditions (moisture, contamination, grease coating) has less effect on the friction force as the force per unit area increases, because there is then a higher probability of any impurities being penetrated by the teeth of the tightening roller, so that only the properties of the belt material affect the friction force. Although this principle is correct, and there would be considerable fluctuations in the belt tension if only one support roller and a moderate pressure were to be used, the fact that, according to the invention, the circumferential region of the tightening roller to which the tightening force is transmitted is increased, and therefore a multiplicity of teeth of the tightening roller come into engagement one behind the other, means that differences in engagement which may arise on the individual teeth statistically balance one another out.

Although it is advantageous for the pressure to be as uniform as possible over the entire distance, since the statistical balancing between the friction relationships on the individual teeth thereby has a better effect, there is no need for this pressure to be strictly constant. It is sufficient for the pressure over the course of the distance or significant parts of this distance to lie in the same order of magnitude. The same order of magnitude means that the differences should not exceed the ratio 1:10. They preferably lie below 1:3.

If the force exerted by the support rollers on the belt is adjustable, in order to be able to set the desired belt tension, the relationship between the pressure acting at the support rollers and the pressure acting in the region between the support rollers may not be constant. In these cases, it is sufficient for the arrangement to be such that, within the setting range, there is a setting at which the force acting per unit length between the belt and the circumference of the tightening roller is approximately the same at the support rollers as between them. In this case, the arrangement is expediently selected in such a way that on setting a low belt tension, the force which acts per unit length between the belt and the circumference of the tightening roller is lower at the support rollers than between them. The force may even be as low as zero at the support rollers. If a maximum belt tension is set, and consequently the support rollers press against the belt with the maximum force, that region of the belt which is situated between the support rollers ought still to contribute considerably to the friction force acting between the tightening roller and the belt. The arrangement is therefore expediently such that, at a high belt tension setting, the pressure acting between the belt and the circumference of the tightening roller, in the region of the support rollers, reaches or slightly exceeds the pressure prevailing in the region between the support rollers, without departing from the same order of magnitude.

Deviations in the dimensions of the belts are compensated by the resilient pressure of the support rollers. This is known per se (U.S. Pat. No. 4,610,067).

In order to bring about a pressure which acts over the distance between the belt and the tightening roller, the two support rollers should not be excessively far apart. Their angular spacing with regard to the tightening roller is preferably 30–70°, more preferably 40–60°. It is also possible to provide a greater number of support rollers.

The tension with which the belt bears against the circumference of the tightening roller between the support rollers depends firstly on the diameter of the tightening roller and on the angular spacing of the support rollers. This tension increases as these dimensions decrease. Secondly, this force depends on the resistance exerted by the belt to its appropriate bending. This is in turn dependent on the modulus of elasticity of the material of the belt and on the second moment of area of the belt cross-section. It is easy to vary these parameters on the basis of tests in such a way that the desired pressure is achieved.

The reproducibility of the belt tension also depends on the shape of the teeth. It has proven expedient for the leading flank of the teeth, in the direction from the tooth root to the tooth tip, to be inclined towards the rear in the direction of rotation of the tightening roller. As a result, the teeth have less tendency to cut into or dent the belt material, but rather slide away over it. The wear is correspondingly lower. The flank angle of the teeth expediently lies between 10° and 45° with respect to the line perpendicular to the belt, more preferably between 18° and 30°. Nevertheless, the teeth should be pointed in cross-section.

If belts which are smooth on one side and are toothed on the other side are used, the invention delivers good results irrespective of whether the teeth of the tightening roller interact with the smooth or the toothed side of the belt. However, it is preferable for them to interact with the toothed side.

It has proven advantageous in this case for the teeth of the tightening roller not to be close together, but rather to have a spacing between them which lies in the order of magnitude of the thickness of the belt.

Figure 2:
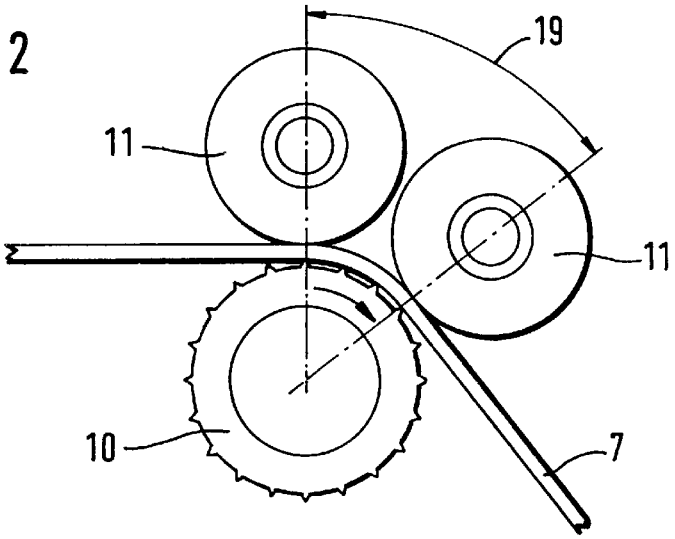

The invention is explained in more detail below with reference to the drawing which illustrates an exemplary embodiment of the invention and in which:

FIG. 1 shows a diagrammatic side view of the front part of the tool on a moderately enlarged scale, and FIG. 2 shows a view of part of the clamping geometry, on a further enlarged scale.

The drawing shows the front part of a so-called cable binding tool, the tool body 1 of which bears on its end wrapping pliers which are formed by the parts 2 and 3 and accommodate a bundle of cables 4 as the objects to be bound, in order to wrap the cable fastener 5 around them. At its end, this fastener has a lock 6, through the opening of which the free end 7 of the cable fastener is guided and which contains a detent pawl, which, by interacting with toothing of the cable fastener, prevents it from moving back through the lock. When the cable fastener has been wrapped around the cable harness 4, the lock 6 is situated in a lock holder (not shown) of the lock at a predetermined position. When the free end 7 is guided through the lock, it passes straight into the tightening device 8, which takes hold of it and pulls it taut around the cable harness 4. When the cable fastener has reached a sufficient tension, that part which protrudes beyond the lock 6 is cut through by a device indicated by an arrow at 9, and the bound cable harness can be removed from the pliers 2, 3.

The tightening device 8 comprises a tightening roller 10, which is mounted at a fixed position in the tool body 1 and can be driven so as to rotate in the direction of the arrow, and two support rollers 11, which press that end 7 of the belt which is to be taken hold of and tightened onto the tightening roller 10. The support rollers 11 are mounted on a rocker 12 which can pivot about a fixed pin 13 in the tool body 1 and is acted on in the anticlockwise direction by means of a spring 14. The force exerted by the spring can be adjusted by means of an adjustment screw 15. A stop 17 determines the distance between the support rollers 11 and the circumference of the tightening roller 10 when there is no belt 7 between them. The distance is set in such a way that the tapering free end of the belt can be taken hold of between the tightening roller 10 and the support roller 11 which is reached first. This distance is smaller than that part of the belt which follows the relatively thin tip.

The tightening roller 10 is provided with teeth which are preferably sharp-edged. The diameter of the tightening roller 10 is expediently a multiple of the thickness of the belt. Preferably it is three to ten times as great. The diameter of the support rollers 11 lies in the same order of magnitude as that of the tightening roller 10. The belt material is expediently tough elastic plastic, in particular polyamide.

The belt bears against the toothed circumference of the tightening roller 10 over the arc (19) defined by the support rollers 11. The extent to which it bends and its stiffness counteracting this bending determine the bearing force in the central region of this distance. The force (arrow 18) with which the support rollers 11 are pressed onto the belt is determined by the setting of the spring 14. If the spring force is set at a low level, the force with which the belt is pressed onto the surface of the tightening roller in the region where the support rollers 11 immediately rest can be lower than the force in the centre of the bearing distance; where the spring force is high, the opposite applies. In any case, the belt bears against the tightening roller 10 over a considerable distance, with a plurality of tightening roller teeth acting on it simultaneously.

After it has been introduced into the tightening device, that end 7 of the belt which is to be tightened is initially conveyed without slippage by the tightening roller. When it tightly surrounds the object to be bound, its tension increases steeply until finally it becomes so great that it is equal to the friction force applied by the tightening roller 10. At this moment, the belt comes to a standstill while the tightening roller 10 continues to move and, owing to its friction force exerted on the belt surface, maintains the tension. The belt tension at which this state occurs is dependent on the setting of the spring 14. Therefore, the belt tension which is to be reached can be set by means of the adjustment screw 15.

At a time at which it is certain that the set belt tension has been reached, the cutting device 9 is switched on. The drive to the tightening roller 10 can then be discontinued as soon as the severed end 7 of the belt has been ejected.

The time at which the cut is made is set in such a way that it has first been possible for precisely that number of revolutions of the tightening roller 10 which is required for the longest possible cable fastener to pass through with the smallest possible cable harness diameter to take place. As a result, unnecessarily long frictional engagement and wear to the tightening roller 10 are avoided.

A guide strip 16 may be provided in the gap between the support rollers 11 and the belt 7, which guide strip, during the insertion operation, guides the tip of the belt from the roller nip at the first support roller 11 to the roller nip at the second support roller 11.

In a tried-and-tested exemplary embodiment, the diameter of the tightening roller (measured to as far as the tooth tips) was 8 mm. The diameter of the support rollers amounted to 7 mm. The angular spacing between the support rollers, with respect to the axis of the tightening roller, was approximately 53°. The circumference of the tightening roller was provided with 20 sharp-edged teeth, the flank angle of which with respect to the radius was 23°. A polyamide belt having a thickness (including toothing) of 1.15 mm and a width of 2.6 mm was processed. The toothed side of the belt faced towards the tightening roller.

When the support rollers were subjected to a force 18 of 30N, the result was a belt tension of approximately 80N. At that position of the belt at which the tightening roller had slipped through with respect to the belt, the teeth of the belt had been pinched and abraded uniformly over a distance of slightly more than 4 mm in length. At the ends of this distance, where the support rollers had been acting, the deformation was less intensive than in the centre of this distance.

When the force 18 was set at approximately 10N, the result was a correspondingly lower belt tension. The distance deformed by the tightening roller had a length of slightly less than 4 mm. The deformation was lower than with the tension set higher and was more intensive in the centre of the distance than at its ends.

What is claimed is:

1. Tool for binding a belt around an object, which tool contains a tightening device (8) for performing a tightening operation on the belt (5) which is resistant to bending, which device comprises a tightening roller (10), which is provided with teeth, said tightening roller is continuously driven during the tightening operation and, on reaching a predetermined belt tension, continues to rotate with respect to the belt (5), and an abutment, which supports the belt (5) on the side opposite the tightening roller, characterized in that the abutment includes at least two support rollers (11) which are arranged at an angular spacing of 30° to 70° on the circumference of the tightening roller (10) and are clamped onto the tightening roller (10) by spring force (14), and the diameter of the tightening roller (10) and the distance between the support rollers in relation to the resistance to bending of the belt (5) are selected in such a way that the force acting per unit length between the belt (5) and the circumference of the tightening roller (10) is approximately the same at the support rollers as between the support rollers.

2. Tool according to claim 1, characterized in that the force exerted by the support rollers (11) on the belt (5) is adjustable over a range of force settings and the range of force settings comprises a setting at which the force acting per unit length between the belt (5) and the circumference of the tightening roller (10) is approximately the same at the support rollers (11) as between the support rollers.

3. Tool according to claim 1, characterized in that the force exerted by the support rollers (11) on the belt (5) is adjustable and, at a low setting of this force, the force acting per unit length between the belt (5) and the circumference of the tightening roller (10) is lower at the support rollers (11) than between them.

4. Tool according to claim 1, characterized in that said tightening wheel has a direction of rotation and each said tooth has a root and a tip connected by a leading flank facing the direction of rotation, and the leading flank of each said tooth is inclined from the root to the tip away from the direction of rotation.

5. Tool according to claim 4, characterized in that each tooth has a trailing flank connecting the root to the tip, said trailing flank facing away from the direction of rotation, said leading and trailing flanks having an angular orientation to a radius of said tightening roller of between 10° and 45°.

6. Tool according to claim 4, characterized in that the teeth are pointed in cross-section.

7. Tool according to claim 1, characterized in that the belt is provided with a toothed surface and the belt is arranged in the device with said toothed surface facing towards the tightening roller (10).

8. Tool according to claim 1, characterized in that said teeth have a pitch and the tooth pitch of the tightening roller (10) is at least approximately equal to the thickness of the belt.

9. A tool for tightening a belt which is resistant to bending around an object, said tool comprising:

a tightening roller having a first diameter and a circumference provided with teeth, and an abutment including at least two support rollers each having a second diameter, said rollers arranged in an angular spaced relationship of 30° to 70° to each other on the circumference of the tightening roller, said abutment and support rollers urged toward said tightening roller by spring force, wherein the belt is inserted between said tightening roller and said abutment, the diameter of the tightening roller and the spacing between the support rollers are selected so that the force acting per unit length between the belt and the circumference of the tightening roller at the support rollers is approximately the same at the support rollers as bet ween them, said tightening roller engages the belt with said teeth and is rotatably driven to pull the belt into said device until the belt reaches a predetermined belt tension, whereupon said tightening roller begins to slip relative to the belt and the belt becomes stationary relative to said device, but said tightening roller continues to rotate with respect to the belt, thereby maintaining said predetermined tension.

10. The tool of claim 9, wherein said spring force is adjustable over a range of settings, said range including a setting at which the force acting per unit length between the belt and the circumference of the tightening roller is approximately the same at the support rollers as between them.

11. The tool of claim 9, wherein said spring force is adjustable and at a low setting of spring force, the force acting per unit length between the belt and the circumference of the tightening roller is lower at the support rollers than between them.

12. The tool of claim 9, wherein the tightening roller has a direction of rotation and said teeth have leading flanks facing in the direction of rotation and trailing flanks facing in the trailing direction, said flanks extending from a tip of said teeth to a root of said teeth, the leading flanks of said teeth having a greater length than the trailing flanks of said teeth, whereby the tips of said teeth are skewed to point away from the direction of rotation.

13. The tool of claim 12, wherein said leading flank and said trailing flank have an angular orientation of between 10° and 45° with respect to a radius of said tightening wheel.

14. The tool of claim 9, wherein said teeth are pointed in cross-section.

15. The tool of claim 9, wherein said belts have a toothed surface and the toothed belts are inserted in said tool with the toothed surface facing toward the tightening roller.

16. The tool of claim 9, wherein said teeth have tips and said belt has a thickness, and a distance between said tips along the circumference of the tightening roller is approximately equal to the thickness of said belt.

17. The tool of claim 9, wherein a ratio of said first diameter to said second diameters does not exceed 1.5:1.

* * * * *